US011976527B2

(12) United States Patent
Patterson et al.

(10) Patent No.: US 11,976,527 B2
(45) **Date of Patent: *May 7, 2024**

(54) SINGLE ACTING SNAP RING GUIDE

(71) Applicant: Halliburton Energy Services, Inc., Houston, TX (US)

(72) Inventors: Daniel Luther Patterson, East Tawakoni, TX (US); William Ewing, Cypress, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/159,548

(22) Filed: Jan. 25, 2023

(65) Prior Publication Data

US 2023/0160274 A1 May 25, 2023

Related U.S. Application Data

(62) Division of application No. 16/614,349, filed as application No. PCT/US2018/067209 on Dec. 21, 2018, now Pat. No. 11,598,169.

(51) Int. Cl.

| | |
|---|---|
| ***E21B 23/12*** | (2006.01) |
| ***E21B 17/06*** | (2006.01) |
| ***E21B 17/10*** | (2006.01) |

(52) U.S. Cl.

CPC ..... *E21B 23/12* (2020.05); *E21B 17/06* (2013.01); *E21B 17/10* (2013.01)

(58) Field of Classification Search

CPC ..... E21B 23/12; E21B 17/10; E21B 17/06; E21B 19/24; E21B 31/00

See application file for complete search history.

(56) References Cited

U.S. PATENT DOCUMENTS

| | | | | | |
|---|---|---|---|---|---|
| 1,837,639 | A | * | 12/1931 | Wickersham | E21B 17/06 285/334.3 |
| 2,695,673 | A | * | 11/1954 | Coyle | E21B 37/02 166/170 |
| 3,054,454 | A | | 9/1962 | Evans | |
| 4,321,965 | A | | 3/1982 | Restarick et al. | |
| 5,454,420 | A | * | 10/1995 | Snider | E21B 23/00 175/85 |
| 5,570,742 | A | * | 11/1996 | Reynolds | E21B 37/02 166/173 |

(Continued)

FOREIGN PATENT DOCUMENTS

| | | |
|---|---|---|
| GB | 2591392 | 12/2022 |
| WO | 2020131108 A1 | 6/2020 |

OTHER PUBLICATIONS

"BR Application No. 112021008002-3, First Office Action", dated Oct. 11, 2022, 4 pages.

(Continued)

*Primary Examiner* — Yung-Suk (Philip) Ro

(74) *Attorney, Agent, or Firm* — DeLizio, Peacock, Lewin & Guerra, LLP

(57) ABSTRACT

A guide assembly comprises a grooved mandrel having a first end adapted for coupling or connecting, a second end, and having a spiral groove and a set of ring grooves on an external surface of the grooved mandrel. The guide assembly comprises a guide shoe concentric to at least the second end of the grooved mandrel and an annular fastener that fastens the guide shoe to the grooved mandrel.

11 Claims, 6 Drawing Sheets

(56) References Cited

U.S. PATENT DOCUMENTS

| | | | | |
|---|---|---|---|---|
| 9,217,301 | B1 * | 12/2015 | Latham | E21B 17/1078 |
| 11,598,169 | B2 * | 3/2023 | Patterson | E21B 17/06 |
| 2002/0005284 | A1 * | 1/2002 | Allen | E21B 37/02 166/173 |
| 2006/0207769 | A1 | 9/2006 | Corbett et al. | |
| 2008/0156479 | A1 | 7/2008 | Cassidy et al. | |
| 2009/0205870 | A1 | 8/2009 | Smith | |
| 2013/0140032 | A1 * | 6/2013 | Ford | E21B 37/00 166/311 |
| 2016/0090816 | A1 | 3/2016 | Gosselin | |
| 2017/0198546 | A1 * | 7/2017 | Gosselin | E21B 33/14 |
| 2017/0321496 | A1 | 11/2017 | Mattson et al. | |
| 2021/0355777 | A1 | 11/2021 | Patterson et al. | |

OTHER PUBLICATIONS

"CN Application No. 2018800988915, First Office Action", dated Dec. 26, 2022, 5 pages.

PCT Application Serial No. PCT/US2018/067209, International Preliminary Report on Patentability, dated Jul. 1, 2021, 9 pages.

PCT Application Serial No. PCT/US2018/067209, International Search Report, dated Sep. 18, 2019, 3 pages.

PCT Application Serial No. PCT/US2018/067209, International Written Opinion, dated Sep. 18, 2019, 8 pages.

SG Application No. 11202101080S, Written Opinion, dated Nov. 24, 2021, 7 pages.

U.S. Appl. No. 16/614,349, Non-Final Office Action, dated Oct. 28, 2021, 12 pages.

GCC Application Serial No. 38436: First Exam Report: dated Feb. 4, 2021, 4 pages.

Indian Application Serial No. 202127011806; First Exam Report; dated Sep. 21, 2021, 9 pages.

"U.S. Appl. No. 16/614,349, Restriction Requirement", dated Jun. 9, 2022, 6 pages.

* cited by examiner

SINGLE ACTING SNAP RING GUIDE

TECHNICAL FIELD

The disclosure generally relates to the field of earth or rock drilling (mining), and more particularly to well equipment or well maintenance.

BACKGROUND ART

Traditional well construction, such as drilling of an oil or gas well, consists of three phases: drilling, lining with casing, and production with tubing. In the drilling phase, rock is cut away until a deposit is reached. This establishes a wellbore or borehole through a series of formations. Each formation through which the well passes must be sealed so as to avoid an undesirable passage of formation fluids, gases, or materials out of the formation and into the borehole or from the borehole into the formation. In addition, it is often desired to isolate both producing and non-producing formations from each other to avoid contaminating one formation with fluids from another formation.

Lining the wellbore with casing protects the formation layers and stabilizes the wellbore. Packers and liners are often used in lining the wellbore to separate fluid types. Packers are tools used to form an annular seal between two concentric strings of pipe or between the pipe and the wall of the open hole and are usually set just above the producing zone to isolate the producing interval from the casing annulus or from producing zones elsewhere in the wellbore. At times, it is not desired for the casing to extend all the way to the surface of the wellbore, in which case a liner is used. A liner is a casing string that does not extend to the top of the wellbore, but instead is anchored or suspended from inside the bottom of the previous casing string.

Production tubing is run into a drilled well after the casing is run and set in place. Production tubing protects the wellbore casing from wear, tear, and corrosion while providing a continuous bore from the producing zone to the wellhead. When sections of production tubing are run into a wellbore, they often run through a packer or liner top to interconnect them. However, packer bores and liner tops are substantially centered in the wellbore. If the wellbore is deviated, the production tubing will tend to engage the edge of the packer bore or liner top instead of entering it. In order to correct this issue, the production tubing is maneuvered to enter the packer bore or liner top. A guide is attached to the lower end of the production tubing to facilitate entering a packer bore or maneuvering past downhole obstructions. The guide typically includes a muleshoe geometry such that rotation of the muleshoe will allow the end of the guide to bypass the top of a packer or obstruction. This rotation may be accomplished by rotating the entire production tubing from the surface. However, when running the production tubing string into a wellbore, the ability to rotate the tubing string to enter into packer bores or liner tops may be prevented due to control lines attached to the tubing and/or extreme hole angles. When rotation of the production tubing is not feasible, there are self-aligning muleshoe guides available that will rotate as the weight of the production tubing string applied to the guide increases due to the guide setting down on a packer bore or liner top. A guide with a muleshoe geometry will enter the packer bore or liner top after sufficient rotation. After the guide enters the packer or liner top, the bottom end of the guide will typically move back to the original position with the assistance of a spring. In addition, the spring designed for use in the guide is designed for the harsh downhole environment, which incurs a significant cost in material and design.

BRIEF DESCRIPTION OF THE DRAWINGS

Embodiments of the disclosure may be better understood by referencing the accompanying drawings.

DESCRIPTION OF EMBODIMENTS

Figure 1:
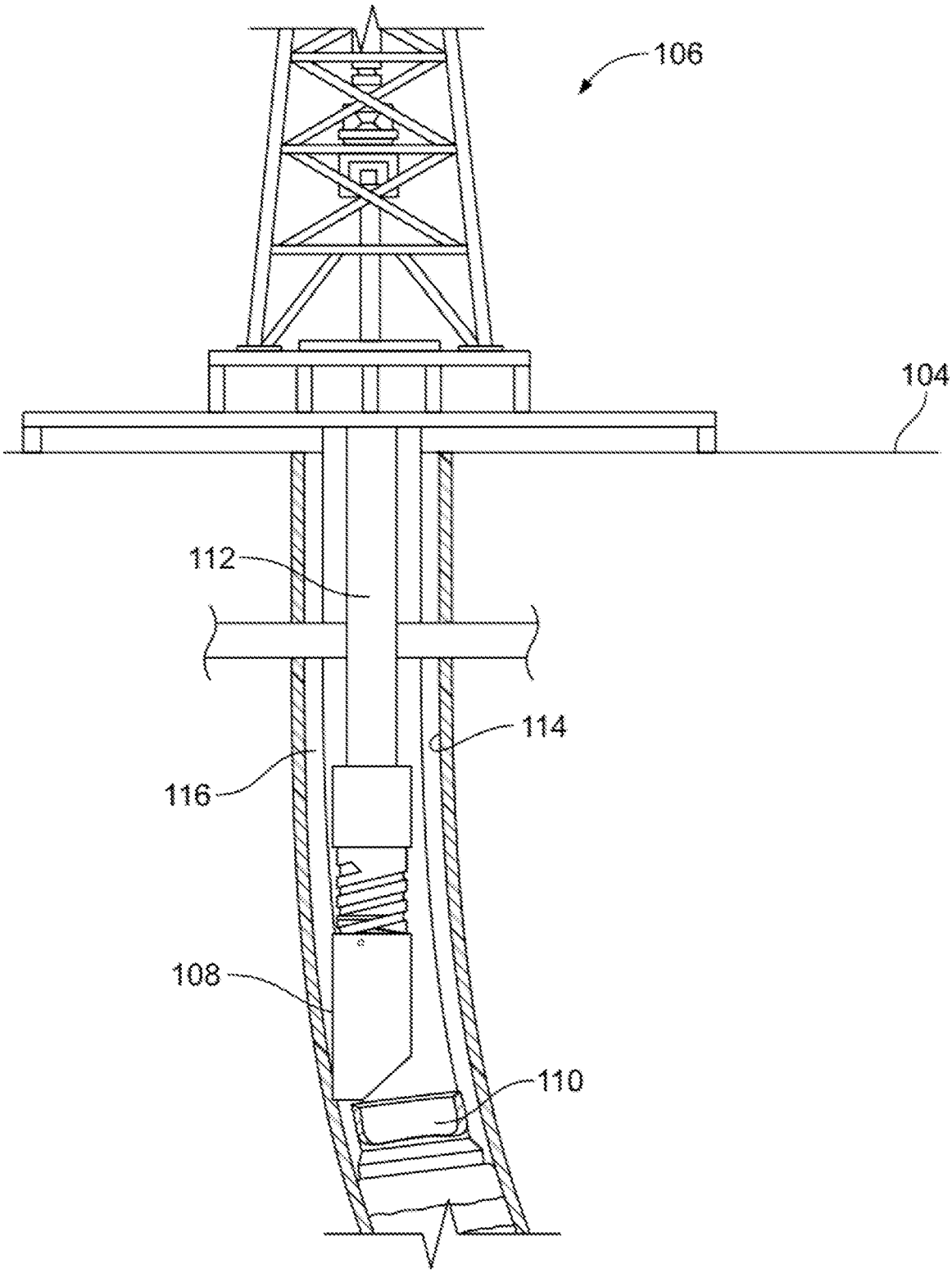
FIG. 1 depicts a schematic diagram of a well system making use of a single acting snap ring guide, according to some embodiments.

The description that follows includes example systems that embody embodiments of the disclosure. However, it is understood that this disclosure may be practiced without these specific details. For instance, this disclosure refers to a single acting snap ring guide for entering a packer bore or liner top in a wellbore for subsurface drilling operations in illustrative examples. Embodiments of this disclosure can be also applied to subsea drilling operations. In other instances, well-known instruction instances, protocols, structures and techniques have not been shown in detail in order not to obfuscate the description.

OVERVIEW

When running production tubing string into a wellbore, a guide is often used on the bottom end of the string to assist maneuvering downhole. Guides are used to keep production tubing centered within the wellbore, thus minimizing problems associated with tubing hitting obstructions (e.g., rock ledges or objects) in the wellbore as the tubing is lowered into the well. A guide has been designed that can rotate without a spring. This springless guide has been designed with a helical or spiral groove to guide the orientation of the guide shoe and with a constant section retaining ring ("snap ring") and at least one circumferential groove for the snap ring to rest and hold the guide shoe in position. When the guide shoe encounters an obstruction, weight of at least the guide itself drives a mandrel of the guide into the guide shoe. As the mandrel is driven down, internal lugs of the guide shoe ride the spiral groove on the mandrel and cause the guide shoe to rotate. If the guide shoe is still in contact with the ledge, and weight is still supplying a force on the guide, the snap ring will be moved out of the current circumferential groove via a beveled edge of the current circumferential groove and snap into a next groove, allowing the guide to continue its rotation as the snap ring moves between circumferential grooves. Once the guide shoe enters the packer or liner top, the guide shoe may stay in its position for future operations. Keeping the guide shoe in the same orientation that allowed it to enter a packer or liner top can increase operational efficiency because it is more likely that it will be in the correct alignment for the next packer bore or liner top encountered in the wellbore. This removes the need for multiple applications of weight to be set down on the guide to index the guide around to the desired orientation. No springs or other mechanisms are required to cause the guide to return to an earlier position.

EXAMPLE ILLUSTRATIONS

In the following description of a single acting snap ring guide assembly and other apparatus and methods described herein, directional terms, such as "top", "bottom", "upper", "lower", etc., are used only for convenience in referring to the accompanying drawings. Specifically, upper and lower are used to refer to different regions, parts, portions, or components of an assembly or equipment when vertically oriented. Additionally, it is to be understood that the various embodiments of the inventive subject matter described herein may be utilized in various orientations, such as inclined, inverted, horizontal, vertical, etc., and in various configurations, without departing from the principles of the embodiments.

FIG. 1 depicts a schematic diagram of a well system making use of a single acting snap ring guide to run a production tubing string into the wellbore. FIG. 1 depicts an example of a well system after a vertical wellbore 114 has been drilled. The well system includes a platform 106 positioned on the earth's surface 104 and extending over and around the wellbore 114. The wellbore 114 extends vertically from the earth's surface 104.

In particular, FIG. 1 depicts the wellbore 114 in which a packer 110 has been inserted downhole. The packer 110 closes off a space between the open hole and a wellbore casing 116 before a production tubing string 112 is run. The packer 110 contains a bore through which the production tubing string can be run. The production tubing string 112 is run into the wellbore 114 with the aid of a guide 108. The guide 108 is a springless muleshoe guide attached to the lower end of the production tubing string 112. The guide 108 is designed to rotate, if needed, to enter the packer 110 without rotating the production tubing string 112 and without stroking (i.e., raising and lowering the string).

Figure 2:
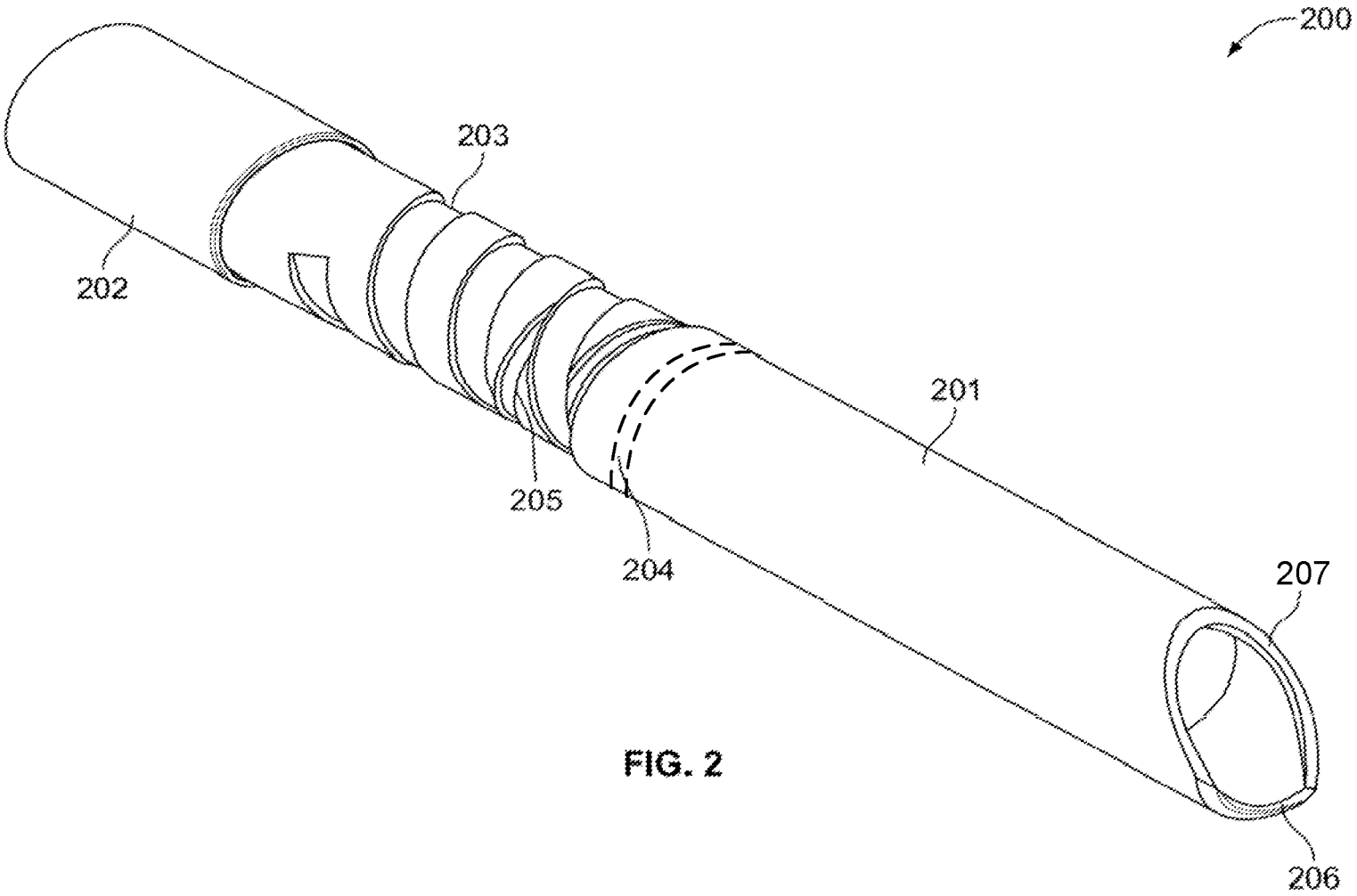
FIG. 2 illustrates an embodiment of a single acting snap ring guide.

FIG. 2 depicts an embodiment of a single acting snap ring guide assembly 200. The single acting snap ring guide assembly 200 consists of a lower muleshoe guide 201 concentric to an upper mandrel 202. A mandrel, as defined herein, may refer to a shaft or tube around which other components are arranged or assembled. The lower muleshoe guide 201 is tapered to allow for orienting around obstructions (e.g., entry into packer bores and liner tops). The tapered bottom end of the lower muleshoe guide 201 has an angular segment 207 and a flat segment 206. The angular segment 207 is cut away from one side of the bottom portion of the lower muleshoe guide 201 while the rest remains flat. The lower muleshoe guide 201 is attached to the mandrel 202 by a snap ring 204. The snap ring 204 is housed within the lower muleshoe guide 201 (as indicated by the dashed lines) and in contact with the external surface of the upper mandrel 202. The illustrated longitudinal location of the snap ring 204 in the springless muleshoe guide assembly 200 is only to illustrate the existence of the snap ring and not a required initial location or resting location. The snap ring 204 is a circular ring that expands and contracts in response to applied forces. The snap ring 204 acts as a wedge, holding the lower muleshoe guide 201 in place relative to the upper mandrel 202. The upper mandrel 202 consists of two sets of grooves (203, 205). Grooves 203 are a set of grooves that spiral around the upper mandrel 202 while grooves 205 are a set of circumferential grooves orthogonal to a central axis of the upper mandrel 202. Grooves 205 are beveled to allow the snap ring 204 to move between the grooves. The snap ring 204 engages with grooves 205 to lock the lower muleshoe guide 201 in place relative to the upper mandrel 202. The snap ring 204 is inside the lower muleshoe guide 201 and outside the upper mandrel 202, attaching the two pieces. Grooves 203 spiral around the upper mandrel 202 and allow the lower muleshoe guide 201 to rotate and move up the upper mandrel 202 when the snap ring 204 is expanded due to an applied force from the load of components above the single acting snap ring guide assembly 200 weighing down upon the single acting snap ring guide assembly 200 when the flat segment 206 encounters or contacts an obstruction.

When the single acting snap ring guide assembly 200 encounters an obstruction (e.g., a packer or liner top) in a wellbore, the flat segment 206 sits down on the liner top. This causes a force due to the weight of the single acting snap ring guide assembly 200 and an attached string above the guide equipment 200 to act on the muleshoe guide 201. This force causes the snap ring 204 to expand and slide out of the grooves 205. With the snap ring 204 disengaged from the grooves 205, the lower muleshoe guide 201 rotates upward relative to the upper mandrel 202 following the grooves 203. If the bottom of the guide is still sitting on the ledge after the snap ring 204 snaps into a first of the orthogonal grooves 205 and contracts, the snap ring 204 will slide out of the current beveled, orthogonal groove and expand to continue its rotation and upward movement. Once the angular segment 207 is aligned in an orientation that allows the guide assembly 200 to enter the packer bore or liner top, the single acting snap ring guide assembly 200 will drop in, removing the force acting on the lower muleshoe guide 201. Thus, the snap ring 204 will once again engage with the grooves 205, and the lower muleshoe guide 201 will stay in this position for future operations. In some cases, the snap ring 204 may not have traveled to one of the grooves 205 when the lower muleshoe guide 201 orients to a position that allows the guide assembly 200 to pass an obstruction. In some embodiments, inertia will allow the snap ring 204 to continue moving along the upper mandrel 202 until the snap ring 204 engages with the next groove 205. In some embodiments, friction between the snap ring 204 and the exterior surface of the upper mandrel 202 between the grooves 205 will be sufficient to hold the lower muleshoe guide 201 in position without the snap ring 204 engaging a groove 205.

Figure 3:
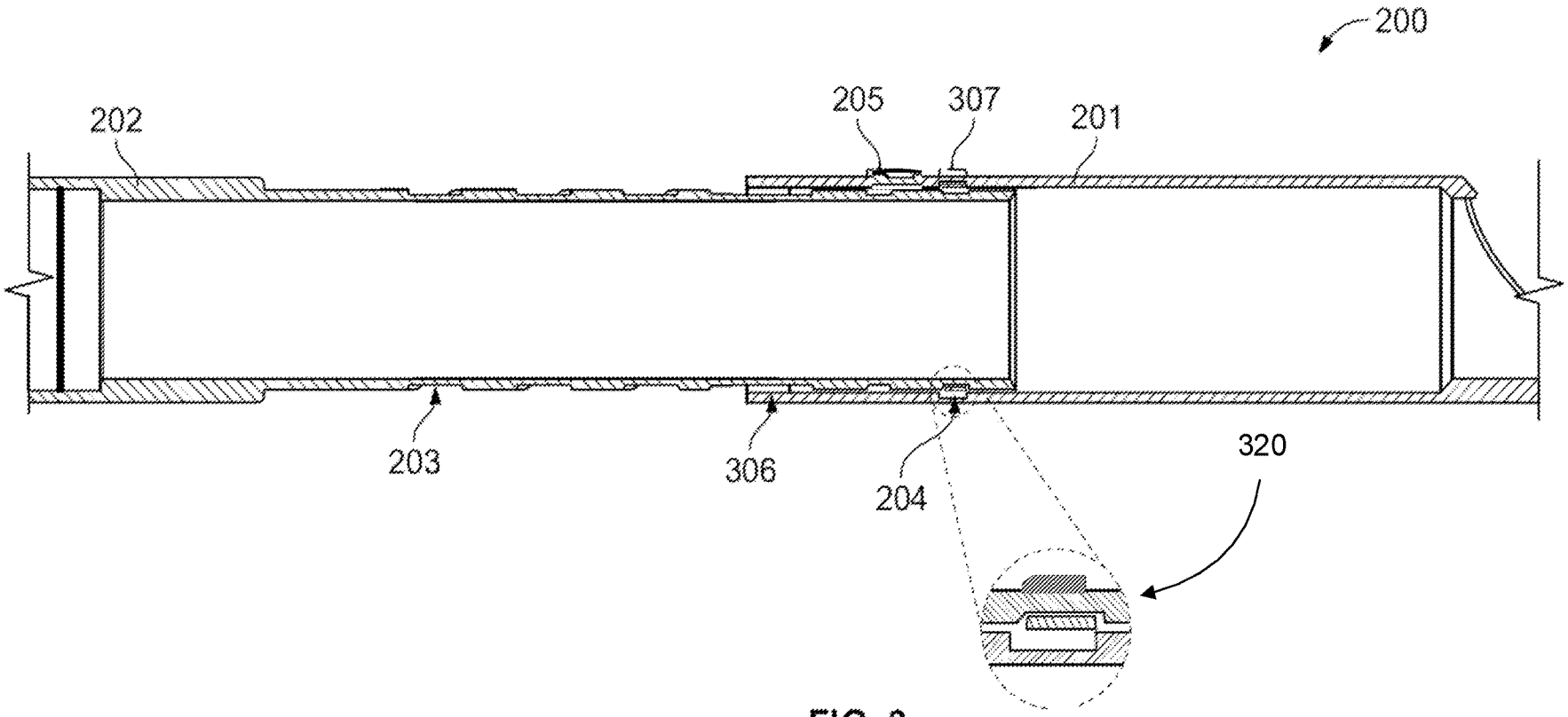
FIG. 3 is a cross-sectional side view of a single acting snap ring guide.

FIG. 3 depicts a cross-sectional side view of the single acting snap ring guide assembly 200 of FIG. 2. The cross-sectional view further displays magnified view 320. The magnified view 320 illustrates the beveled edge of the snap ring 204 and its position between the upper mandrel 202 and the lower muleshoe guide 201 when engaged in one of the circumferential grooves 205. The snap ring 204 has an inner edge bevel from an approximate midpoint of a top (i.e., towards the upper mandrel and away from the shoe) at 45 degrees to an interior of the snap ring 204 to align with the beveled edge of the circumferential grooves 205. The alignment of the beveled edges facilitates mating of the snap ring 204 with the beveled edges of circumferential grooves 205. This reduces the likelihood that the snap ring 204 will catch on an edge of the circumferential grooves 205 or another part of the upper mandrel 202 and maintains a predictable snapping action. The lower muleshoe guide 201 consists of an internal recessed channel or a cutout 307 that houses the snap ring 204 when the snap ring 204 is in an expanded position. The cutout 307 is circumferential about the inner diameter of the lower muleshoe guide 201. When the snap ring 204 expands, the snap ring 204 slides out of the grooves 205 and into the cutout 307. The snap ring travels up the upper mandrel 202 in the cutout 307 to the next groove 205. This sequence of expanding out of the groove 205 into the cutout 307, traveling up the upper mandrel 202, and reengaging with the next sequential groove 205 continues until the lower muleshoe 201 orients to pass an obstruction (e.g., enter the packer bore). In some cases, the snap ring 204 may not have traveled to one of the grooves 205 when the lower muleshoe guide 201 orients to a position that allows the guide assembly 200 to pass an obstruction. In some embodiments, the snap ring 204 will remain in the position when the guide assembly 200 can pass the obstruction and hold the lower muleshoe guide 201 in place due to tension of the snap ring 204 and/or inter-surface adhesion between the surface of the snap ring 204 and the exterior surface between the grooves 205 of the mandrel 202.

FIG. 3 depicts a set of lugs 306 internal to the lower muleshoe guide 201 ("internal lugs") on the upper portion of the lower muleshoe guide 201. The lugs 306 connect the top end of the lower muleshoe guide 201 to the bottom of the upper mandrel 202. In some embodiments, the lugs 306 are comprised of individual protrusions spaced along the upper portion of the lower muleshoe guide 201. In other embodiments, the lugs 306 are comprised of a spiral protrusion. The spiral protrusion aligns with the spacing and angular configuration of the grooves 203 on the upper mandrel 202. The lugs 306 on the lower muleshoe guide 201 ride in the spiral grooves 203 on the upper mandrel 202. As the lower muleshoe guide 201 is pushed upward by the force acting on the guide assembly 200, the lower muleshoe guide 201 rotates due to the lugs 306 riding in the spiral groove 203 on the upper mandrel 202.

Figure 4:
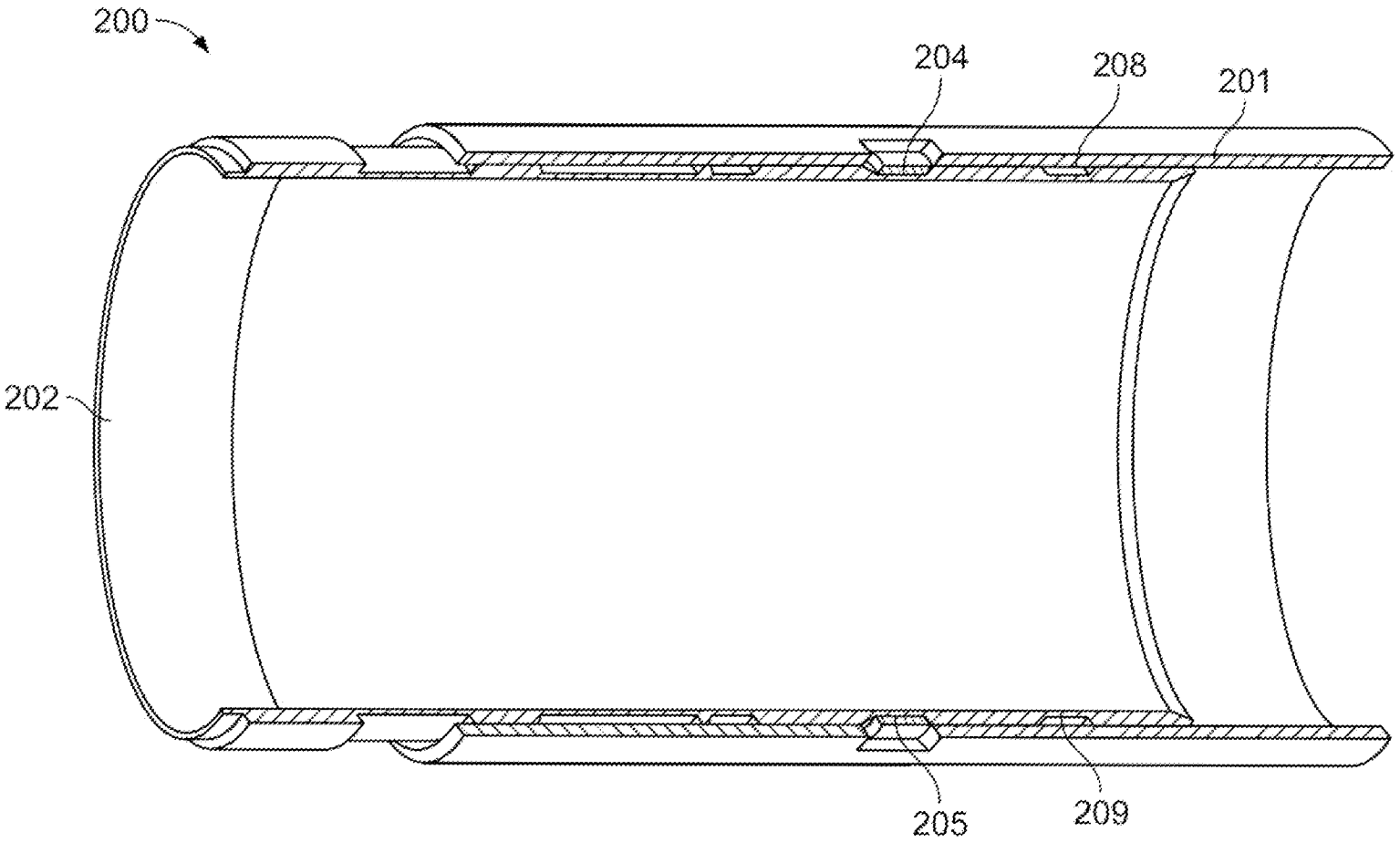
FIG. 4 depicts a cross sectional cutout view of the snap ring in a groove on the upper mandrel.

FIG. 4 depicts a cross-sectional cutout view of the snap ring 204 in a groove 205 on the upper mandrel of the springless muleshoe guide assembly 200 of FIG. 2. FIG. 4A shows the full circumference of a snap ring 400 when positioned in a groove 205 on the upper mandrel 202. A portion of the lower muleshoe guide 201 is removed to show the entire snap ring 400. The snap ring 400 is positioned between the inner surface of the lower muleshoe guide 201 and the outer surface of the upper mandrel 202. The upper mandrel 202 has a set of ring grooves 205 that are circumferential to the upper mandrel 202 and are positioned orthogonal to the central axis of the mandrel 202. The grooves 205 have edges (208, 209) to allow the snap ring 400 to move out of the grooves 205 when a force is applied on the lower muleshoe guide 201 in an upward direction (i.e., when the lower muleshoe guide 201 engages with an obstruction) and retain the lower muleshoe guide 201 in place when not encountering an obstruction. The edge 208 is shaped to prevent the snap ring 400 from moving out of the groove 205 when the lower muleshoe guide 201 does not encounter an obstruction. For instance, the edge 208 can be a square edge. The edge 209 is shaped to allow the snap ring 400 to move out of the groove 205 when the lower muleshoe guide 201 engages an obstruction. Thus, the edge 209 can be an angled or beveled edge that allows the snap ring 400 to slide out of the groove 205 when the lower muleshoe guide 201 encounters an obstruction.

Figure 4B:
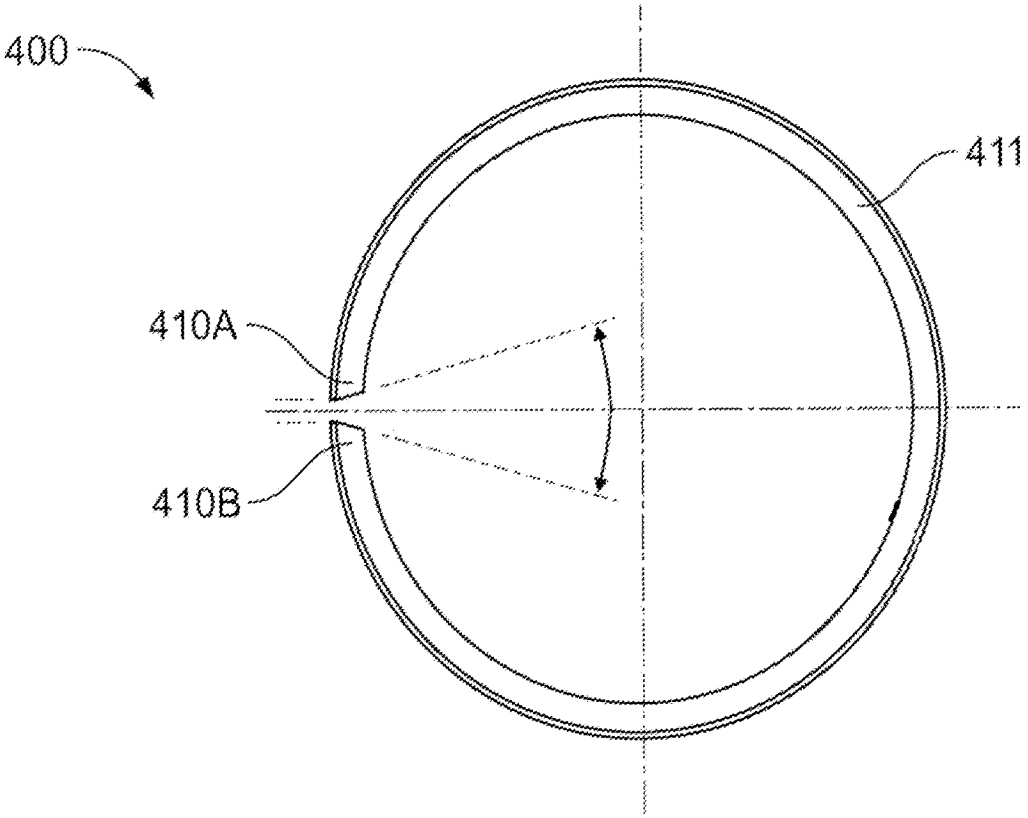
FIGS. 4A-B represent a cross-sectional cutaway view of the snap ring in a groove on the upper mandrel and an embodiment of a snap ring to be used in the springless muleshoe guide assembly.
Figure 4A:
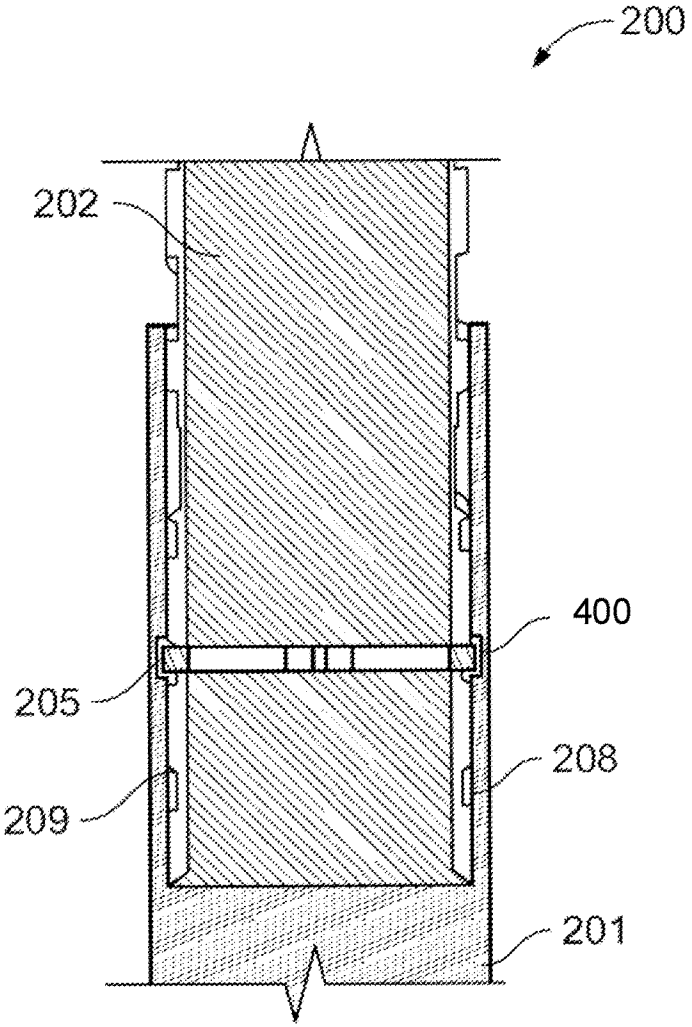

FIG. 4B depicts the snap ring for use in the single acting snap ring guide assembly 200 of FIG. 4A. The snap ring 400 is an annular fastener with an opening. The snap ring 400 acts as a wedge, holding the lower muleshoe guide 201 in place relative to the mandrel 202. The snap ring 400 consists of a retaining ring 411 and two ends (410A, 410B). When a force is applied to the lower muleshoe guide 201 of FIG. 4A, the ring 411 takes on an elliptical deformation. Due to the deformation, the ring 411 contacts the groove 205 of FIG. 4A at three or more isolated points long the groove 205, but not continuously around the circumference. The elliptical deformation causes the ends (410A, 410B) to separate, allowing the snap ring to disengage from the groove 205. When the force is removed, the ends (410A, 410B) return to the original position and engage the next groove 205.

Figure 5:
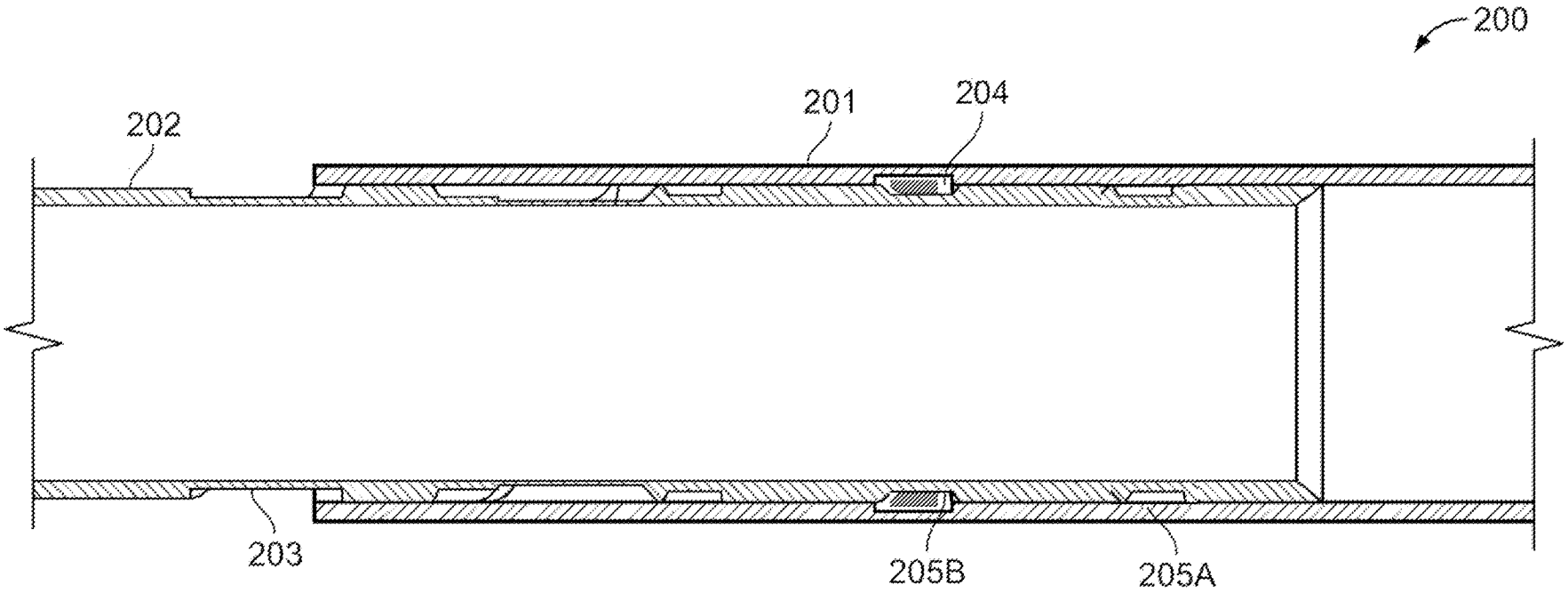
FIG. 5 is a cross-sectional, zoomed in side view of the snap ring having jumped from first groove to the next groove on the mandrel.

FIG. 5 illustrates a cross-sectional, magnified view of the overlapping portions of the single acting snap ring guide assembly 200 of FIG. 2. FIG. 5 illustrates the position of the snap ring 204 after jumping from one circumferential groove to the next. Snap ring 204 engages the grooves 205A or 205B when a force is not applied on the guide 200. When the lower muleshoe guide 201 encounters an obstruction, the corresponding force causes the snap ring 204 to slide from one groove to the next, sequentially, since the snap ring 204 is attached to the lower muleshoe guide 201 upon which the force is applied. Before weight is set down on the guide, the snap ring 204 is engaged in groove 205A. When weight is applied to the guide assembly 200, the snap ring 204 elastically deforms and disengages from groove 205A. The weight causes the muleshoe guide 201 to rotate upward around spiral groove 203. For each groove 205 the snap ring 204 jumps, the lower muleshoe guide 201 will rotate an angular distance defined by the longitudinal distance between grooves 205 and angle of the spiral grooves 203. In some embodiments, each groove 205 will correspond to a 60-degree rotation of the lower muleshoe guide 201 around the upper mandrel 202. As an example, the mandrel 202 can be made with six of the grooves 205 at a distance apart corresponding to the groove 203 spiraling at an angle adapted to allow the lower muleshoe guide 201 to complete one full, 360-degree rotation. This angular rotation turns the lower muleshoe guide 201 until aligned in an orientation to pass an obstruction. When the lower muleshoe guide 201 passes the obstruction, the force is no longer applied, and the snap ring 204 will engage the next groove 205B. This action holds the lower muleshoe guide 201 in position.

While the previous example referred to a design with 6 ring grooves to allow for a single 360-degree rotation of the lower muleshoe guide, a guide assembly design will vary depending upon a specified maximum degree of rotation or full rotations. Design attributes of the guide assembly that can influence the amount of rotation include length of the upper mandrel, number of ring grooves, and helix pitch or helix angle. Length of the upper mandrel limits longitudinal distance that can be traveled by the lower muleshoe guide. With the maximum longitudinal distance that can be traveled by the lower muleshoe guide and a specified total number of full rotations to allow, the number of ring grooves and either helix pitch or helix angle can be specified in design of the helical groove.

While the illustrations above refer to a snap ring, embodiments are not limited to a snap ring. Embodiments use an annular fastener that elastically deforms to exit a ring groove to then travel along a portion of a mandrel between grooves.

The embodiments described herein use a single action, caused by an application of force applied due to contact with a packer or liner top, to place the guide in the desired position to enter a packer bore or liner top. Single action is the ability to accomplish work in only one direction. Single action as used herein refers to the rotation of lower muleshoe guide being only in a direction upward with respect to the upper mandrel. The snap ring allows for the single action rotation of the lower muleshoe guide and removes the need for a long coil spring as used in traditional self-aligning tubing guides. By not using long coil springs the risk of potential malfunction or introduction of debris in the hole is reduced. This reduces cost and increase reliability over current guides.

While the aspects of the disclosure are described with reference to various implementations and exploitations, it will be understood that these aspects are illustrative and that the scope of the claims is not limited to them. Plural instances may be provided for components, operations or structures described herein as a single instance. Finally, boundaries between various components, operations and data stores are somewhat arbitrary, and particular operations are illustrated in the context of specific illustrative configurations. Other allocations of functionality are envisioned and may fall within the scope of the disclosure. In general, structures and functionality presented as separate components in the example configurations may be implemented as a combined structure or component. Similarly, structures and functionality presented as a single component may be implemented as separate components. These and other variations, modifications, additions, and improvements may fall within the scope of the disclosure.

Use of the phrase "at least one of" preceding a list with the conjunction "and" should not be treated as an exclusive list and should not be construed as a list of categories with one item from each category, unless specifically stated otherwise. A clause that recites "at least one of A, B, and C" can be infringed with only one of the listed items, multiple of the listed items, and one or more of the items in the list and another item not listed.

EXAMPLE EMBODIMENTS

Example Embodiments include the following:

Embodiment 1: A muleshoe guide assembly comprising: an upper mandrel having a first end adapted to couple to a string and having a plurality of grooves in an external surface of the upper mandrel, wherein the plurality of grooves comprises a helical groove and a set of ring grooves; a lower muleshoe guide concentric to at least a lower portion of the upper mandrel; and a snap ring located within the lower muleshoe guide and attaching the lower muleshoe guide to the upper mandrel.

Embodiment 2: The muleshoe guide assembly of Embodiment 1, wherein the set of ring grooves are substantially orthogonal to a longitudinal axis of the upper mandrel.

Embodiment 3: The muleshoe guide assembly of Embodiment 1 or 2, wherein the snap ring is positioned in one of the set of ring grooves when engaged with the upper mandrel.

Embodiment 4: The muleshoe guide assembly of an of Embodiments 1-3, wherein the snap ring is positioned in a cutout in the inner circumference of the lower muleshoe guide when the snap ring is disengaged from the grooved mandrel.

Embodiment 5: The muleshoe guide assembly of any of Embodiments 1-4, wherein the lower muleshoe guide comprises internal lugs adapted to ride in the helical groove wrapping around the upper mandrel.

Embodiment 6: The muleshoe guide assembly of any of Embodiments 1-5, wherein at least a first of the set of ring grooves comprises a beveled edge, the beveled edge being towards the first end of the upper mandrel, and the snap ring comprises a bevel adapted to mate with the beveled edge.

Embodiment 7: The muleshoe guide assembly of any of Embodiments 1-6, wherein the first ring groove also comprises a squared edge, the squared edge being towards a second end of the upper mandrel.

Embodiment 8: A guide assembly comprising: a grooved mandrel having a first end adapted for coupling or connecting, a second end, and having a spiral groove and a set of ring grooves on an external surface of the grooved mandrel; a guide shoe concentric to at least the second end of the grooved mandrel; and an annular fastener that fastens the guide shoe to the grooved mandrel.

Embodiment 9: The guide assembly of Embodiment 8, wherein the guide shoe comprises a tapered bottom portion.

Embodiment 10: The guide assembly of Embodiments 8 or 9, wherein the annular fastener is adapted to elastically deform when exiting one of the set of ring grooves.

Embodiment 11: The guide assembly of any of Embodiments 8-10, wherein each of the set of ring grooves is substantially orthogonal to a longitudinal axis of the grooved mandrel.

Embodiment 12: The guide assembly of any of Embodiments 8-11, wherein the guide shoe comprises an internal undercut adapted to accommodate the annular ring when elastically deformed.

Embodiment 13: The guide assembly of any of Embodiments 8-12, wherein the guide shoe comprises internal lugs adapted to ride in the spiral groove to allow the guide shoe to rotate about the grooved mandrel.

Embodiment 14: The guide assembly of any of Embodiments 8-13, wherein at least a first ring groove of the set of ring grooves comprises a first edge adapted to allow the annular fastener to move out of the first ring groove, the first edge being towards the first end of the grooved mandrel.

Embodiment 15: The guide assembly of any of Embodiments 8-14, wherein the first ring groove comprises a second edge adapted to prevent the annular fastener from exiting the first ring groove towards the second end of the grooved mandrel.

Embodiment 16: A guide assembly for running string into a wellbore, the guide assembly comprising: a mandrel having a first end that is a coupling end and a second end, and having an external set of ring grooves and an external helical groove; an annular fastener capable of elastic deformation, the annular fastener fastening a guide shoe to the mandrel; and the guide shoe comprising an internal cutout to house the annular fastener when elastically deformed and internal lugs that ride within the external helical groove of the mandrel when the guide shoe rotates about the mandrel, the guide shoe being concentric to at least a lower portion of the mandrel.

Embodiment 17: The guide assembly of Embodiment 16, wherein the annular fastener can elastically deform to exit one of the external set of ring grooves.

Embodiment 18: The guide assembly of any of Embodiments 16-17, wherein the annular fastener is a snap ring.

Embodiment 19: The guide assembly of any of Embodiments 16-18, wherein a number of the external set of ring grooves and the external helical groove are adapted to allow for at least one full rotation of the shoe guide about the mandrel.

Embodiment 20: The guide assembly of any of Embodiments 16-19, wherein each of the external set of ring grooves comprises a beveled edge and a squared edge, the beveled edge towards the first end of the mandrel and the squared edge towards the second end of the mandrel.

What is claimed is:

1. A guide assembly comprising:

a grooved mandrel having a first end adapted for coupling or connecting, a second end, and having a spiral groove and a set of ring grooves on an external surface of the grooved mandrel;

a guide shoe concentric to at least the second end of the grooved mandrel, the guide shoe including an internal undercut and one or more lugs, the lugs adapted to ride in the spiral groove to allow the guide shoe to rotate about the grooved mandrel; and an annular fastener that resides within the internal undercut of the guide shoe and within one of the ring grooves of the grooved mandrel, the annular fastener preventing the guide shoe from rotating along the spiral grove while the annular fastener remains in the ring groove of the guide shoe and in one of the ring grooves of the grooved mandrel.

2. The guide assembly of claim 1, wherein the guide shoe comprises a tapered bottom portion.

3. The guide assembly of claim 1, wherein the annular fastener comprises an elastically deformable annular fastener.

4. The guide assembly of claim 3, wherein the internal undercut is adapted to accommodate the elastically deformable annular fastener.

5. The guide assembly of claim 1, wherein each of the set of ring grooves is substantially orthogonal to a longitudinal axis of the grooved mandrel.

6. The guide assembly of claim 1, wherein at least a first ring groove of the set of ring grooves comprises a first edge adapted to allow the annular fastener to move out of the first ring groove, the first edge being towards the first end of the grooved mandrel.

7. The guide assembly of claim 6, wherein the first ring groove comprises a second edge adapted to prevent the annular fastener from exiting the first ring groove towards the second end of the grooved mandrel.

8. The guide assembly of claim 1, wherein the guide shoe is springless.

9. The guide assembly of claim 1, wherein at least a first ring groove of the set of ring grooves comprises a first edge adapted to allow the elastically deformed annular fastener to move out of the first ring groove, the first edge being towards the first end of the grooved mandrel.

10. The guide assembly of claim 1, wherein the one or more lugs are configured to rotate the guide shoe around the spiral groove as the elastically deformed annular fastener moves out of the first ring groove.

11. The guide assembly of claim 1, wherein the one or more lugs are configured to rotate the guide shoe around the spiral groove as the elastically deformed annular fastener moves out of the first ring groove and to continue rotating the guide shoe around the spiral groove until the elastically deformed annular fastener enters a second one of the ring grooves.

* * * * *